US006615841B2

(12) United States Patent
DeLoach

(10) Patent No.: US 6,615,841 B2
(45) Date of Patent: Sep. 9, 2003

(54) FULCRUM AND CANTILEVER HUMIDOR

(76) Inventor: Guy M DeLoach, 187 Grassland Dr., Jackson, TN (US) 38305

( * ) Notice: Subject to any disclaimer, the term of this patent is extended or adjusted under 35 U.S.C. 154(b) by 0 days.

(21) Appl. No.: 09/940,948

(22) Filed: Aug. 28, 2001

(65) Prior Publication Data

US 2003/0041868 A1 Mar. 6, 2003

(51) Int. Cl.[7] ..... A24F 25/00; B01F 3/06

(52) U.S. Cl. ..... 131/329; 131/300; 131/290; 312/31; 206/213.1

(58) Field of Search ..... 131/329, 290, 131/300, 303; 312/31, 902, 266; 206/213.1, 205, 349, 372; 261/94; 119/312, 314, 300

(56) References Cited

U.S. PATENT DOCUMENTS

| | | | | |
|---|---|---|---|---|
| 273,205 | A | | 2/1883 | Wentzell |
| 336,615 | A | * | 2/1886 | Adams |
| 441,557 | A | | 11/1890 | Heydt |
| 510,928 | A | | 12/1893 | Parish |
| 693,469 | A | | 2/1902 | Wagner et al. |
| 720,111 | A | | 2/1903 | Castillo |
| 1,054,159 | A | | 2/1913 | Wilson |
| 1,474,264 | A | | 11/1923 | Karp |
| 1,668,892 | A | | 5/1928 | Durham |
| 1,676,118 | A | | 7/1928 | Sukert |
| 1,681,953 | A | * | 8/1928 | Saben |
| 1,712,024 | A | | 5/1929 | Brogden |
| 1,893,526 | A | * | 1/1933 | Shriver |
| 1,954,577 | A | | 4/1934 | Reddin |
| 1,992,435 | A | * | 2/1935 | Labadie et al. ..... 206/44 |
| 2,086,813 | A | * | 7/1937 | Markey ..... 119/300 |
| 2,474,173 | A | | 6/1949 | Trinko |
| 2,506,191 | A | * | 5/1950 | Bayuk ..... 312/31.3 |
| 2,977,171 | A | * | 3/1961 | Gleason ..... 312/31 |
| 3,147,738 | A | * | 9/1964 | Theilig ..... 119/322 |
| 3,489,124 | A | * | 1/1970 | Cannon ..... 119/322 |
| 5,607,051 | A | | 3/1997 | Espinosa |
| 5,970,987 | A | | 10/1999 | Barreiro, Jr. |
| 6,047,701 | A | * | 4/2000 | Feldman ..... 131/303 |

* cited by examiner

*Primary Examiner*—Dionne A. Walls

(57) ABSTRACT

A humidor 30 for the retaining and preserving of tobacco products includes multiple independent storage compartments 29 arranged vertically with hygrometers 9 mounted externally for ease of monitoring internal humidity levels. Independent storage compartments swivel in a variety of directions allowing multiple opening configurations and accessibility. Rotational means is achieved via a fulcrum and cantilever mechanism 12. Compartments are sealed air tight utilizing a sealing gasket material 15 imbedded within the side wall of the compartment above and mating with the side wall 11 of the compartment below. The vertical array of independent storage compartments swivel around a common bottom support base 24. Each independent storage compartment utilizes an integrated venting structure comprised of a bottom vent panel 10, a venting side panel 7, a humidity generating means, and a hygrometer 9. The humidor is preferably made of wood.

13 Claims, 13 Drawing Sheets

FULCRUM AND CANTILEVER HUMIDOR

CROSS REFERENCES TO RELATED APPLICATION

Not Applicable

BACKGROUND—FIELD OF INVENTION

This invention relates to humidors for the storage of tobacco and tobacco products, specifically to an improved mechanism for opening, presenting and the storage of tobacco related products.

BACKGROUND—DESCRIPTION OF PRIOR ART

One of the principal objects of the invention is to provide a humidor wherein different types or blends of tobacco or tobacco products may be stored in a properly humidified atmosphere without loss or adulteration of aroma or taste. Another object is to provide a humidor having a integrated venting system for the proper humidification and monitoring of tobacco with a plurality of compartments. These plurality of compartments are independent of each other thus preventing adulteration via airborne ethers from individual tobacco products such as different types of cigars or pipe tobacco. A further object is to provide a humidor that can fully display all tobacco product inventories in a multiple of configurations and orientations at once with an efficient utilization of space.

Prior art multi-compartment humidors as described in U.S. Pat. No. 2,506,191 have separate compartments that all communicate with a source or sources of moisture. This prior art is constructed to ensure that all compartments are exposed to moisture while preventing the aroma from tobacco products in one compartment from migrating into another compartment in a manner that could achieve contamination of the unique tobacco flavor and aroma in each of the separate compartments. The cigar consumer enjoys the unique flavors of different cigars for different occasions and settings. When cigars of various flavors and construction are stored together or have communication to a single humidity source a marrying process occurs. This marrying process or adulteration occurs because of oils secreted by the tobacco leafs. These oils create airborne ethers that merge with all of the cigars stored in a common or communal compartments. This communication between the different cigars causes them to lose their unique flavor and distinction thus lessoning the enjoyment of tobacco products.

U.S. Pat. No. 720,111 shows a cigar makers work box with separate compartments for filler, binder, and wrapper for finished cigars. All cigars communicate with a single source of water.

U.S. Pat. No. 273,205 shows a cabinet for storing cigars and pipe tobacco. Cigars are stored on the shelves in an upper portion of the cabinet and the entire are enclosed by shelves that communicate with a single fluid reservoir near the bottom of the cabinet. Pipe tobacco products are stored similarly and communicate with a separate reservoir with appropriate aromatic liquids for imparting a desired taste and aroma to the pipe tobacco.

(a) The Prior art utilizes an external enclosure or structural support member in the form of a case or cabinet design. This case, cabinet or supporting structure encompasses a plurality of shelves, compartments or drawers creating a need for additional materials for construction, more fabrication steps and a greater cost to the product.

(b) Once the external enclosure or support member is constructed the ability to expand its storage capacity is limited and only expandable by constructing additional supportive members and making significant renovations which require additional fabrication and materials.

(c) The combination of the cabinet, the individual drawers or compartments show a design that provides an inferior seal (drawer to lid fit) that allows water molecules to escape. This mechanical fit over time, use and wear will deteriorate causing excessive moisture to escape and possible adulteration of the products within.

(d) This supporting structure, cabinet or case also inhibits the ability to display or have access to the contents. Access and display of prior art contents is limited to only one compartment at a time and/or to compartments in one orientation thus limiting the efficient utilization of space.

(e) Previous multiple independent compartment humidors have not incorporated an integrated venting structure. A problem with these humidors have been that they do not uniformly distribute humidified air throughout the cigars that the individual compartments contain. The suspended water molecules cannot pass freely and at a sufficient volume rate through the pile of cigars to adequately moisten- and maintain the cigars in the middle of the pile. U.S. Pat. No. 5,970,987 shows a humidor with a venting structure with a fluid reservoir in the bottom. The significant flaw in this design is the adulteration of different cigars being stored together and communicating with a common reservoir. The venting structure as described in this prior art actually accelerates the adulteration process unique thus destroying the unique flavors of the cigars or pipe tobacco. The prior art can only store one type of cigar without adulteration. The prior art can not be vertically arranged due to an integrated top wall used for accessing the humidors contents. Most consumers enjoy several distinct flavors of cigars. In the prior art example one must have additional individual humidors to achieve this, which requires additional materials, storage space and cost.

(f) Another problem with communicating with a reservoir in the bottom of the humidor as presented in the prior art is that water molecules are heavier than air and will have a layering effect inside the humidor creating a stratified humidity level within the humidor. Cigars stored on the bottom next to the humidity generating device will have a different humidity than those at the top.

(g) In order to properly monitor the long term storage of tobacco products the humidity level must be monitored at all times. This normally occurs through the utilization of a hygrometer. Most hygrometers in prior art are mounted inside of the compartment usually on the lid and one must open the humidor to read the humidity level indicated. This action disturbs the controlled humidity level within by exposing it to an external humidity environment. Also due to the layering effect of humidified air the hygrometer located in the top of the humidor does not accurately reflect the humidity of the cigars in the bottom or middle of the humidor.

SUMMARY INCLUDING OBJECTS AND ADVANTAGES

A humidor is provided for retaining and preserving tobacco products within a plurality of vertically arranged storage compartments which are comprised of a side and bottom wall. These storage compartments are independently sealed to prevent communication with the other compartments. Compartments swivel around an integrated rotational mechanism allowing access to contents. These rotating compartments also swivel around a common support base allowing flexible accessability and orientation. An integrated venting structure within each individual compartment allows free air circulation between humidity generating means, humidity monitoring device and tobacco products without causing adulteration of tobacco products within each distinct compartment.

OBJECTS AND ADVANTAGES (a) Accordingly, several objects and advantages of my invention are greater reliability and simplicity through the utlization of a fulcrum and cantilever design that allows any number of independent humdified compartments to be stacked vertically and rotate around a fulcrum for opening and easy accessability. This eliminates the need and materials of a cabinet case or external supportive enclosure as in previous art, which provided support and a seal for the seperate drawers, compartments or shelves construction.

(b) Expandability of the humidors storage capacity is achieved quite simply by inserting additional compartments within the body of the humidor in a modular fashion. This expansion only increases the height of the humidor. This allows the consumer flexibility in designing the humidor to their specific requirements and maximizing efficiency of shelf/desk space.

(c) A superior seal is achieved through the utilization of a gasket material. This seal will provide a better airtight compartment than a cabinet and drawer fit that is subject to warpage and wear overtime. The seal is assured through the life of the product due to the constant downward pressure applied by the weight of the individual compartments, thus allowing conformance of the gasket material to any irregularities in the mating surface.

(d) The integrated rotational mechanism also allows the opening of seperate compartments individually or by rotating all compartments around the fulcrum together each compartment can be displayed at varying directons at one time. By varying the height and positon of the fulcrum one can open or display the tobacco products in various methods and positions, thus giving optimal effeciency in desk space. By adapting the cantilever and fulcrum design in a vertical application one can open multiple compartments at once by simply lifting the top segment upward thus allowing access to all compartments with one opening action. This adds ease of use and greater flexibility in the presentation of tobacco products. This is further enhanced by incorporating a rotational base that allows all of the segments to be rotated in any direction around the base of the multi-compartment humidor giving 360 degree accessability.

(e) Other objects and advantages are an independent internal venting structure within each separate storage compartment that incorporates the following items. A support structure that allows equally distributed humidified air between the tobacco products, humidity generating device and humidity monitoring device.

(f) The fluid reservoir or humidity generating device is mounted on the same horizontal plane as the cigars providing a more homogeneous humidity level within the humidor and thus the tobacco products themselves.

(g) The hygrometer or humidity monitoring device is mounted on a horizontal plane and externally viewable which provides more accurate measuring of the humidity level and monitoring without having to open any of the compartments thus eliminating disturbance to the humidity controlled environment inside the compartments.

Still further objects and advantages will become apparent from a consideration of the ensuing description and accompanying drawings.

BRIEF DESCRIPTION OF THE DRAWINGS

FIG. 4A is a cross-sectional view showing various rotational hinge designs by which the compartments rotate on.

REFERENCE NUMERALS

Figure 1A:
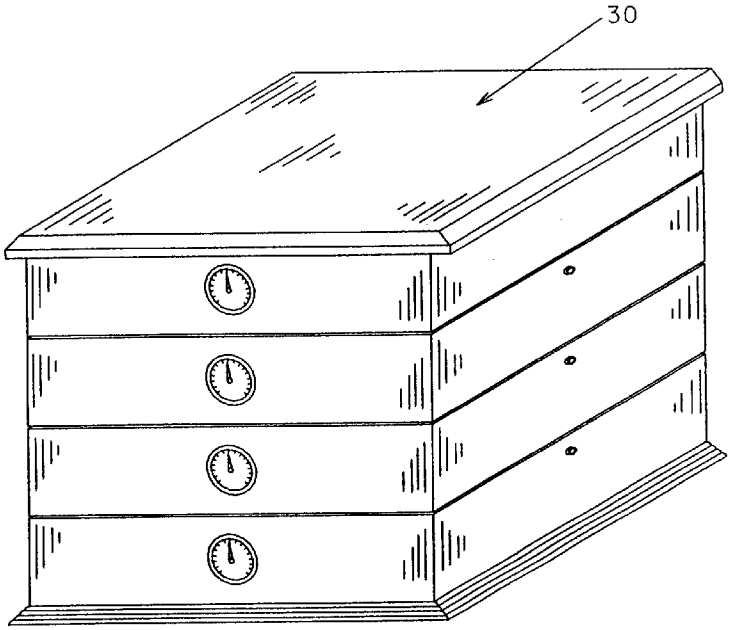
FIG. 1A is a perspective view of the humidor showing independent storage compartments stacked vertically with hygrometers for indicating humidity levels.
Figure 1B:
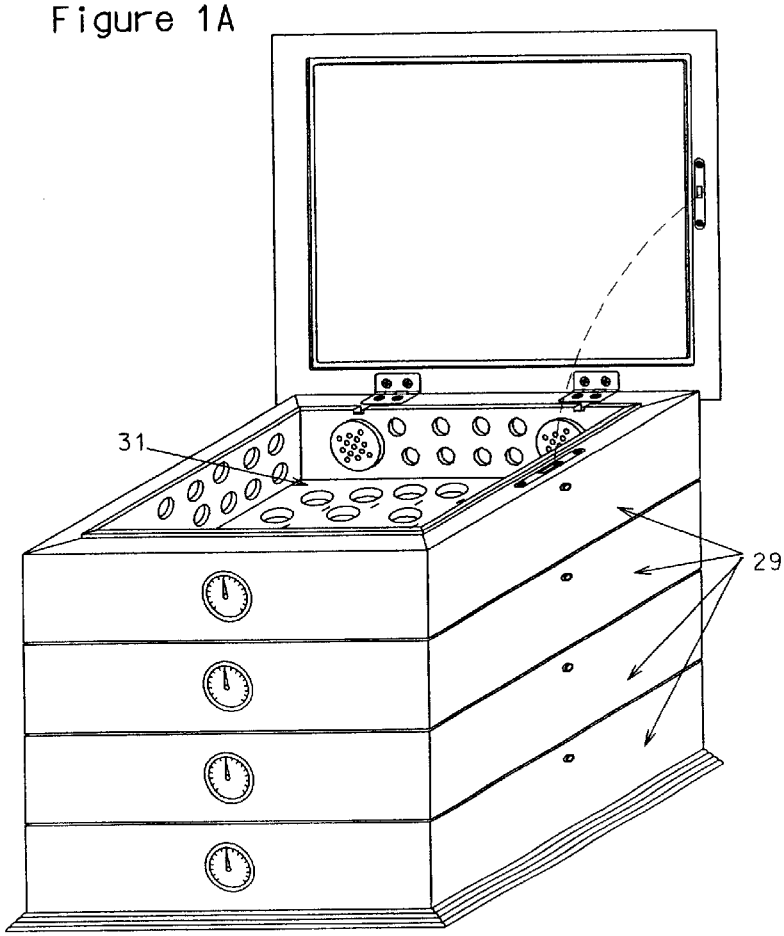
FIG. 1B shows a view of the humidor with the top lid open exposing the internal structure of the top storage compartment

1 top lid
2 hinges

3 locking plate
5 lock
6 humidity generating device
7 venting side panels
8 key hole
9 hygrometers
10 bottom vent pane
11 housing sidewalls
12 fulcrum
13 clearance space
15 sealing gasket
16 compartment bottom wall
17 spacers
18 air passage space
19 rising swivel hinge
20 simple rotational hinge
21 threaded hinge
22 cantilevers
23 elongated humidity generating device
24 bottom support base
25 accessory storage divider
26 storage compartment divider
28 rotational stop
29 independent storage compartments 29
30 humidor
31 integrated venting structure 31
32 air passing vent openings
33 openings for humidity generating device
34 mechanical seal
34A mechanical seal

PREFERRED EMBODIMENT—DESCRIPTION

Referring to FIGS. 1A–1D

Figure 1C:
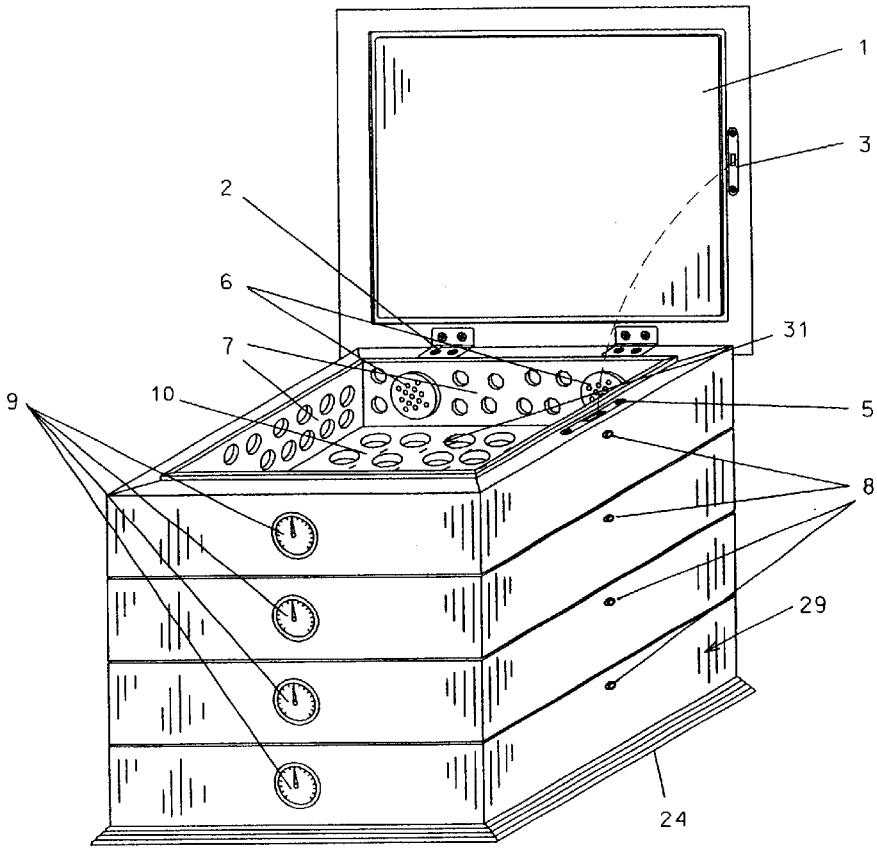
FIG. 1C is a an overall perspective view of the humidor with components identified.
Figure 1D:
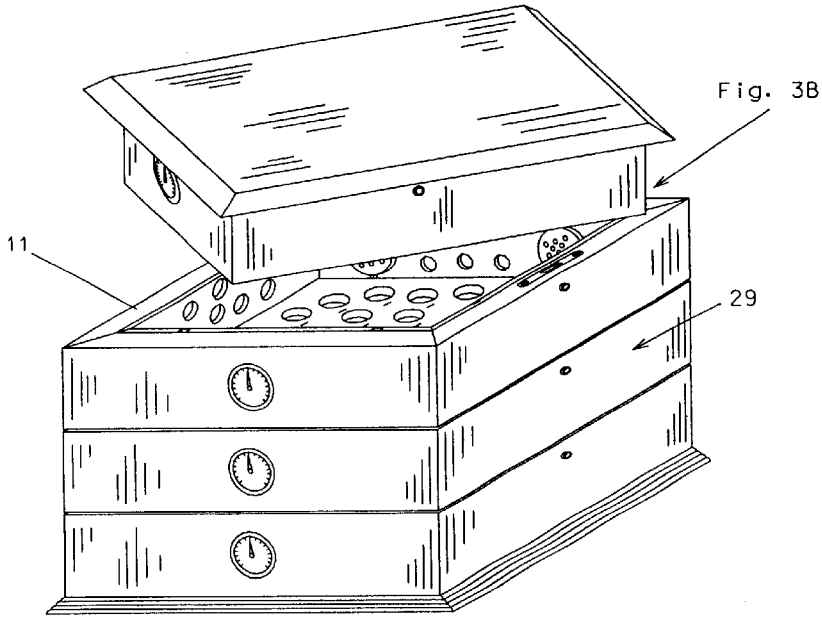
FIG. 1D shows the top compartment rotating to reveal a lower storage compartment

FIG. 1A is a perspective view of a humidor 30 showing independent storage compartments stacked vertically with hygrometers mounted in the front panels for indicating the humidity level within the closed compartments. Humidor 30 size can be varied simply by adding or reducing the number of vertically stacked compartments. FIG. 1 B shows a view of the humidor with the top lid open exposing a internal integrated venting structure 31. A humidor 30 is comprised of vertically stacked independent storage compartments 29. FIG. 1C is an overall perspective view of a humidor 30 with the top lid 1 open. The top lid is joined to the upper storage compartment 29 by way of hinges 2. Inside storage compartment 29 is a integrated venting structure 31. A storage compartment 29 is made up of a housing bottom wall and housing sidewalls 11. Hygrometers 9 are mounted into the housing sidewalls. A locking mechanism for securing the compartment is comprised of a key hole 8, lock 5, and a mating locking plate 3. A humidity generating device 6 is retained partially within the side housing walls 11. The storage compartments are supported by and rotate on a bottom support base 24.

Figure 2A:
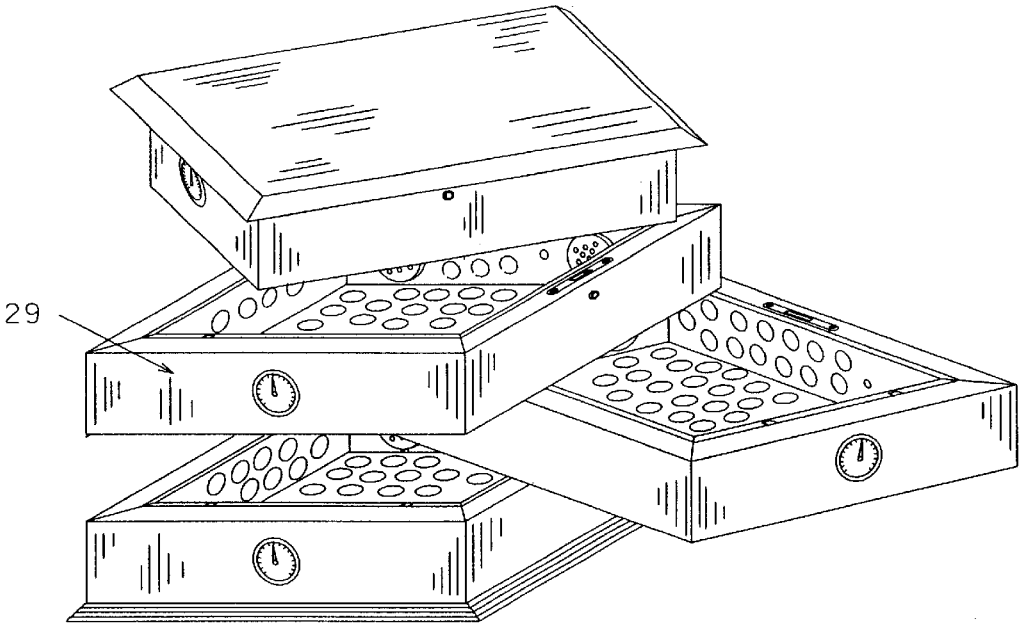
FIG. 2A shows the independent storage compartments rotating open in several different directions
Figure 2B:
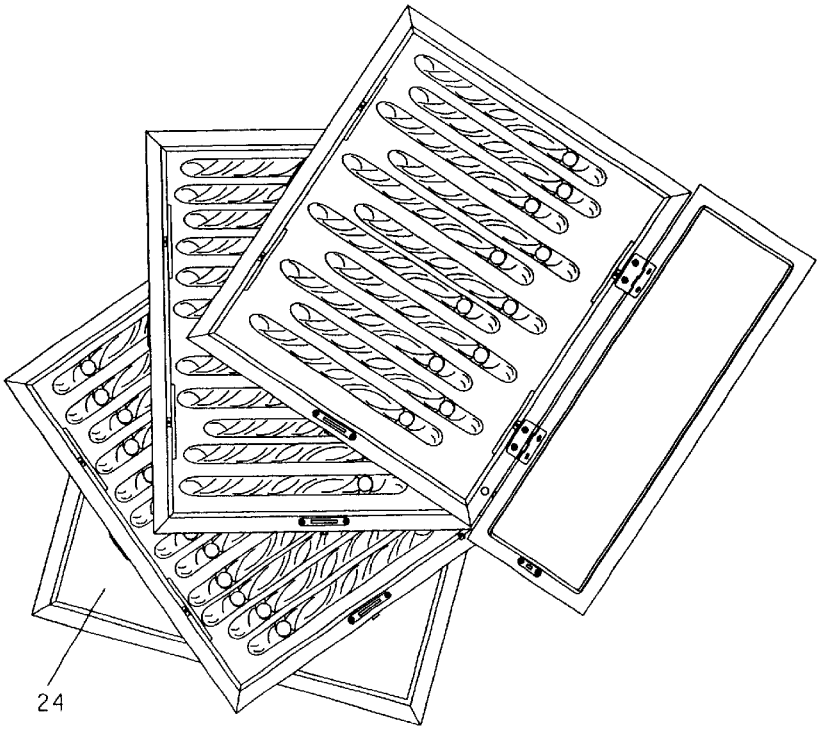
FIG. 2B is a top plan view showing the individual compartments rotated open and with the bottom compartment rotating on a fixed base.
Figure 3A:
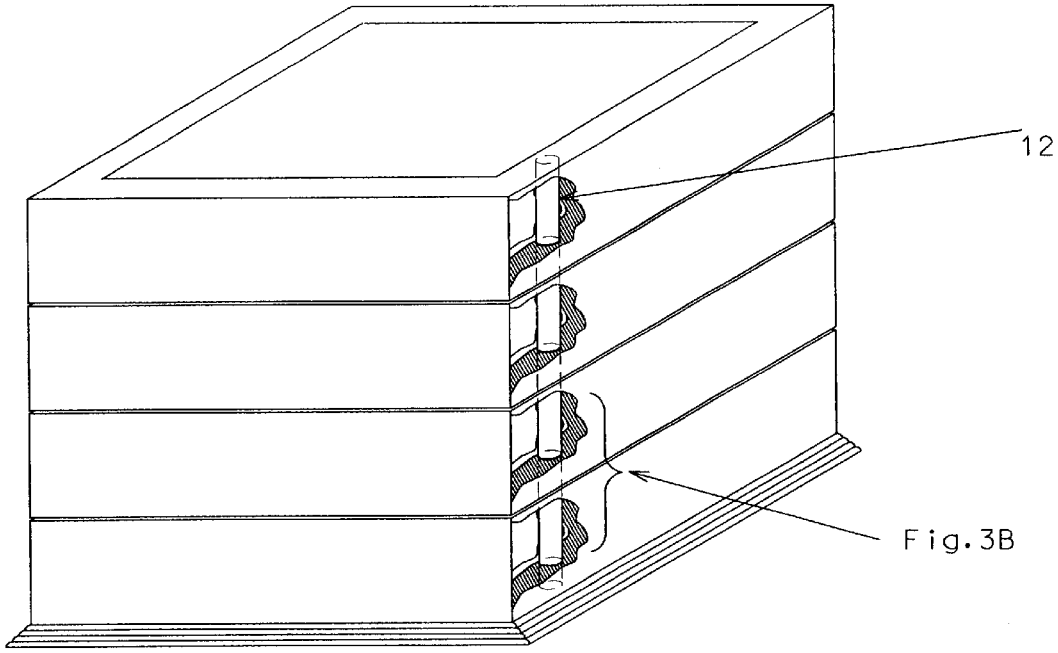
FIG. 3A is a cross-sectional view of the fulcrum by which the individual compartments rotate around.
Figure 3B:
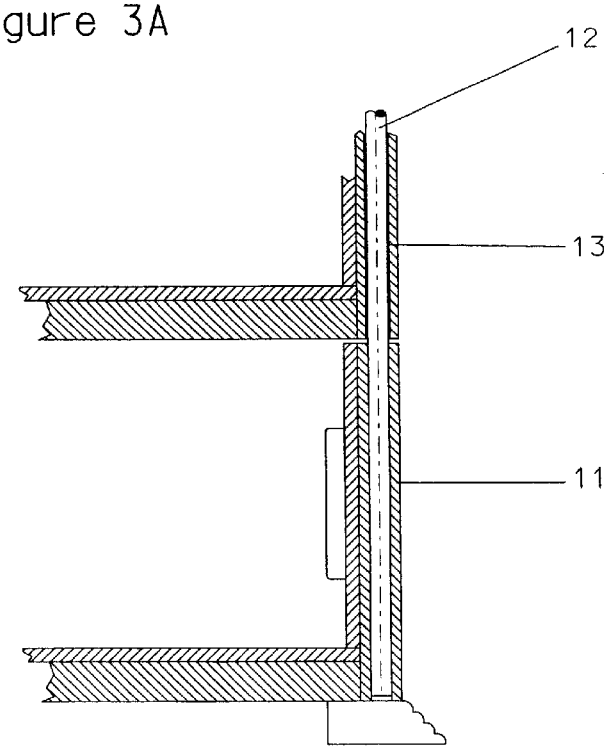
FIG. 3B is a view in detail of the fulcrum installation between compartments as indicated in FIG. 3A
Figure 3C:
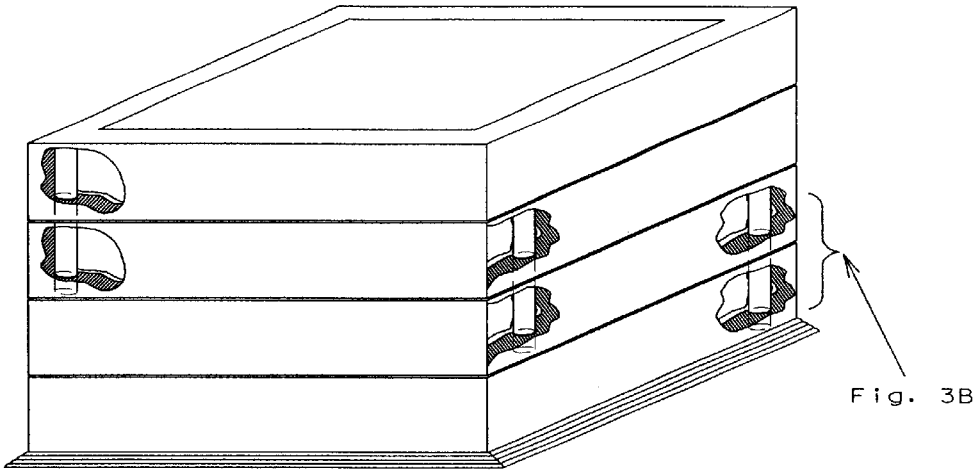
FIG. 3C is a cross-sectional view of a optional fulcrum design and placement
Figure 3D:
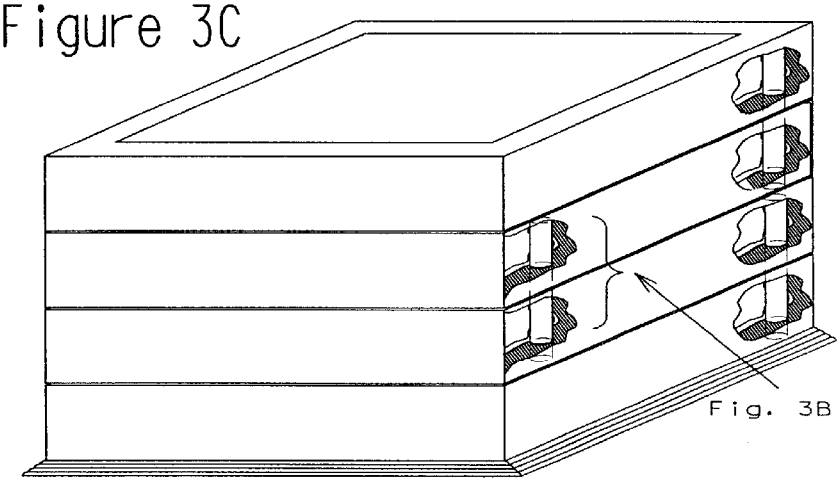
FIG. 3D is a cross-sectional view of an optional fulcrum design and placement.
Figure 3E:
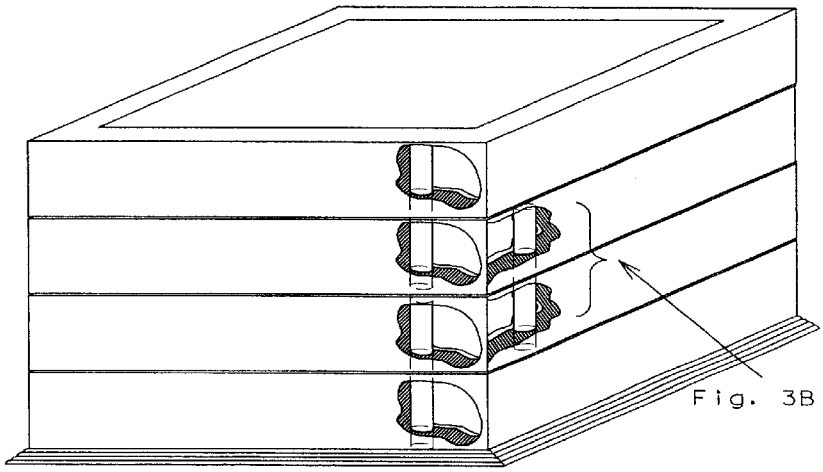
FIG. 3E is a cross-sectional view of an optional fulcrum design and placement.

FIG. 2A and 2B shows the independent storage compartments rotating or swiveling in a variety of directions. Rotation on bottom support base 24 is achieved via an integrated swivel connection. Rotation of storage compartments 29 is achieved via a fulcrum 12 in FIG. 3A. Fulcrum 12 is press fitted into lower compartment housing wall 11 causing an interference fit. Upper compartment 29 has a clearance space 13 between fulcrum 12 and housing side wall 11 allowing a free rotation or swivel of compartment 29 around the fulcrum 12. FIGS. 3C through 3E shows a variety of configurations and placements of fulcrum 12 within housing sidewalls of individual storage compartments 29. These different configurations allow multiple rotational and opening arrangements of all the compartments.

Figure 5A:
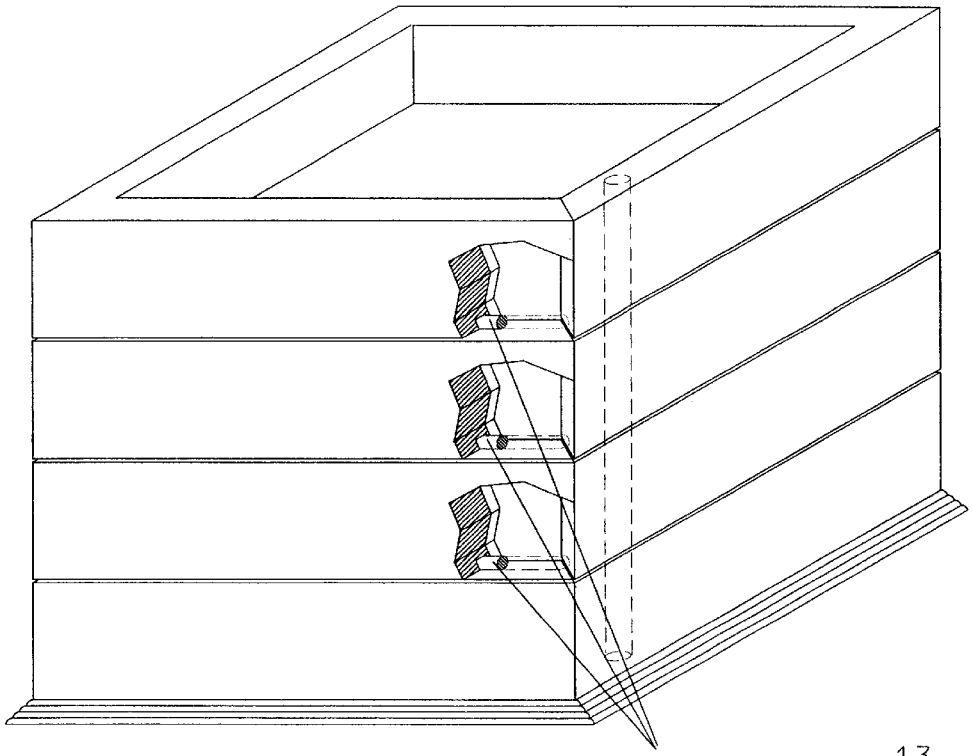
FIG. 5A is a cross-sectional view of the sealing gasket within each compartment.
Figure 6A:
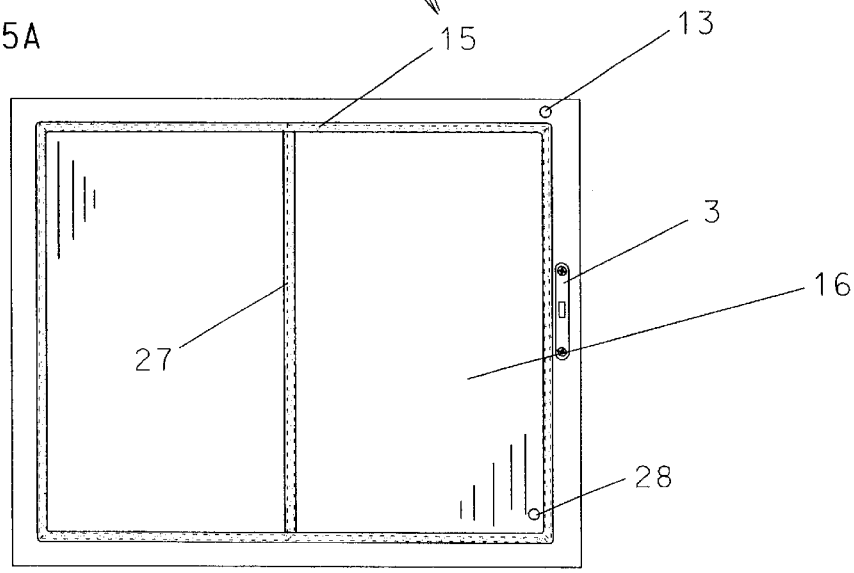
FIG. 6A is a bottom plan view of an individual storage compartment
Figure 7A:
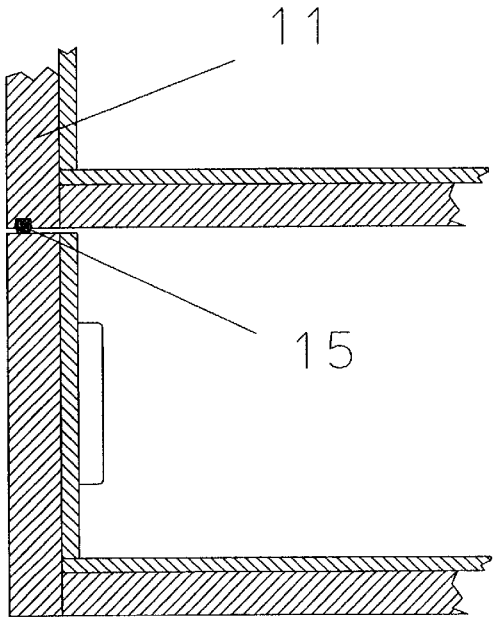
FIG. 7A is a cross-sectional view of the sealing gasket position, mating surface and storage compartment wall structure.

Referring to FIGS. 5A, 6A and 7A.

FIG. 5A is a cut away view of compartment bottom wall 16 and the sealing gasket within the housing side wall of each independent storage compartment. Sealing gasket 15 is made up of a closed cell neoprene material, silicone or other nontoxic sealing material that provides a uniform seal between gasket 15 and lower compartment sidewall. Sealing gasket 15 is retained partially into the bottom of the side housing wall. FIG. 6A shows a bottom plan view of the storage compartment. The sealing gasket 15 extends around the complete exterior of the compartment sidewalls creating a leak proof or airtight seal for the compartment. Lock plate 3 is mounted into the bottom of sidewall to allow locking of compartment levels. Rotational stop 28 is located in the bottom wall of compartment 16 and constructed of a suitable material usually in a dowel shape. This rotational stop 28 slightly extends past seal gasket height. This stop 28 allows compartment to open 90 degrees in one optimal direction. The stop can be placed in a variety of configurations allowing optimal opening configurations. FIG. 7A is a cross-sectional view of the sealing gasket located in the upper compartment side wall. The gasket seals air tight against the lower compartment side wall 11.

Referring to FIGS. 8A through 8D

Figure 8A:
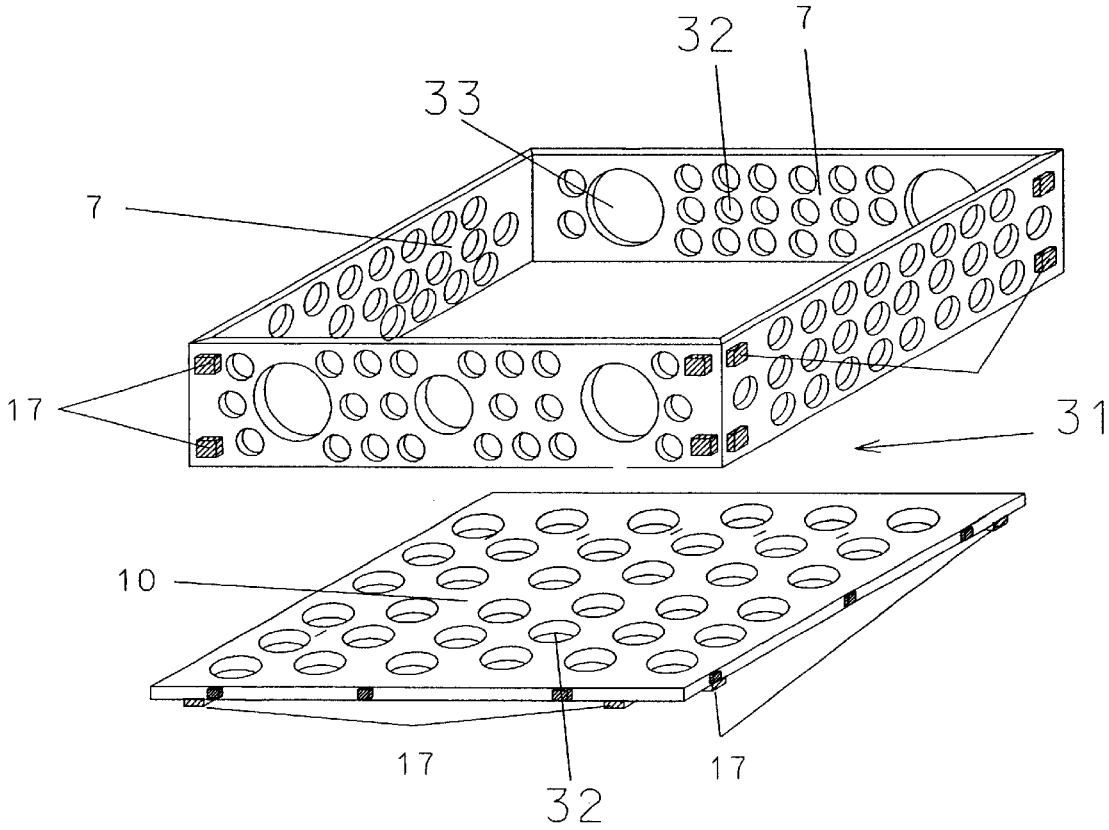
FIG. 8A is a perspective view of the internal integrated venting structure
Figure 8B:
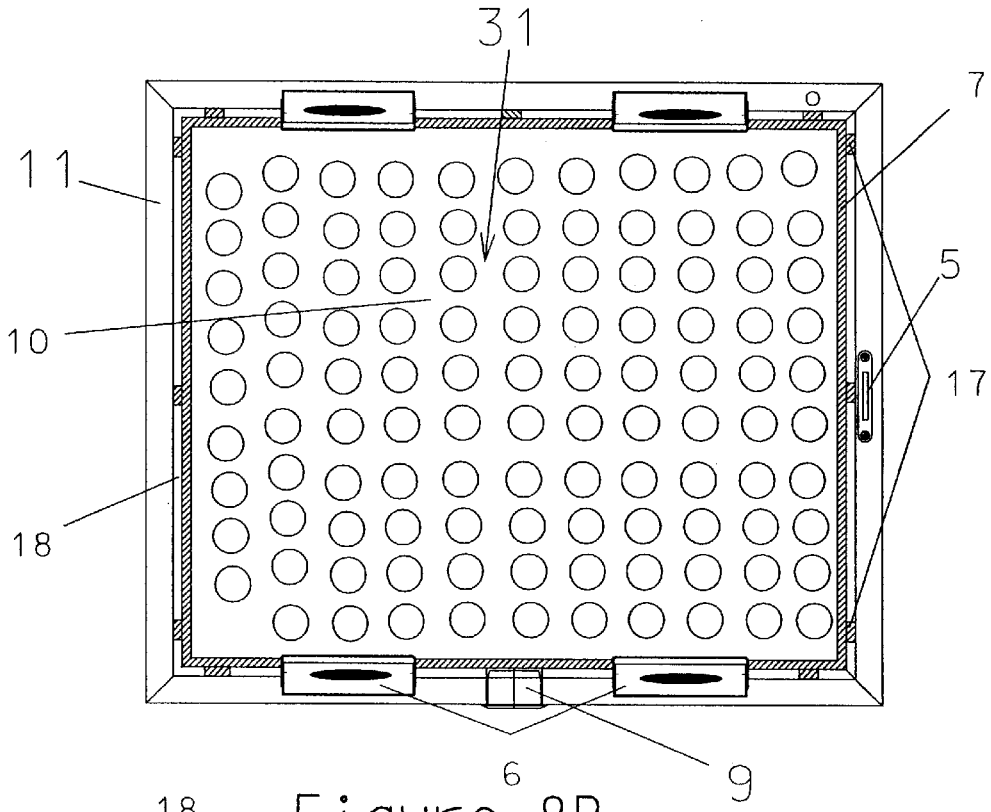
FIG. 8B is a top plan view of the internal venting structure within the storage compartment
Figure 8C:
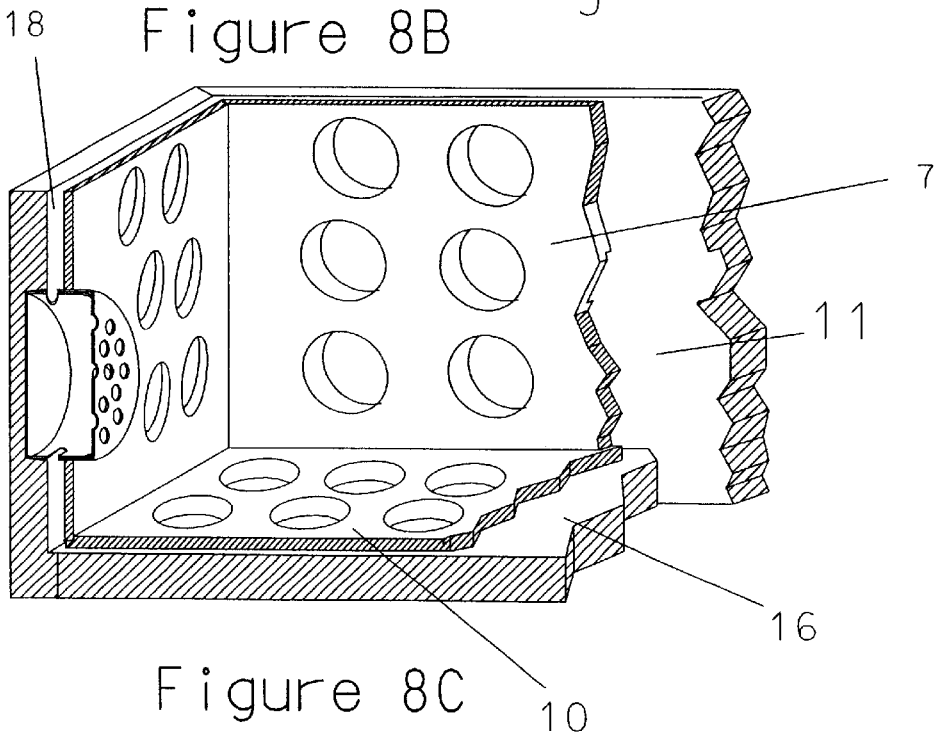
FIG. 8C is a detailed view of the internal integrated venting structure
Figure 8D:
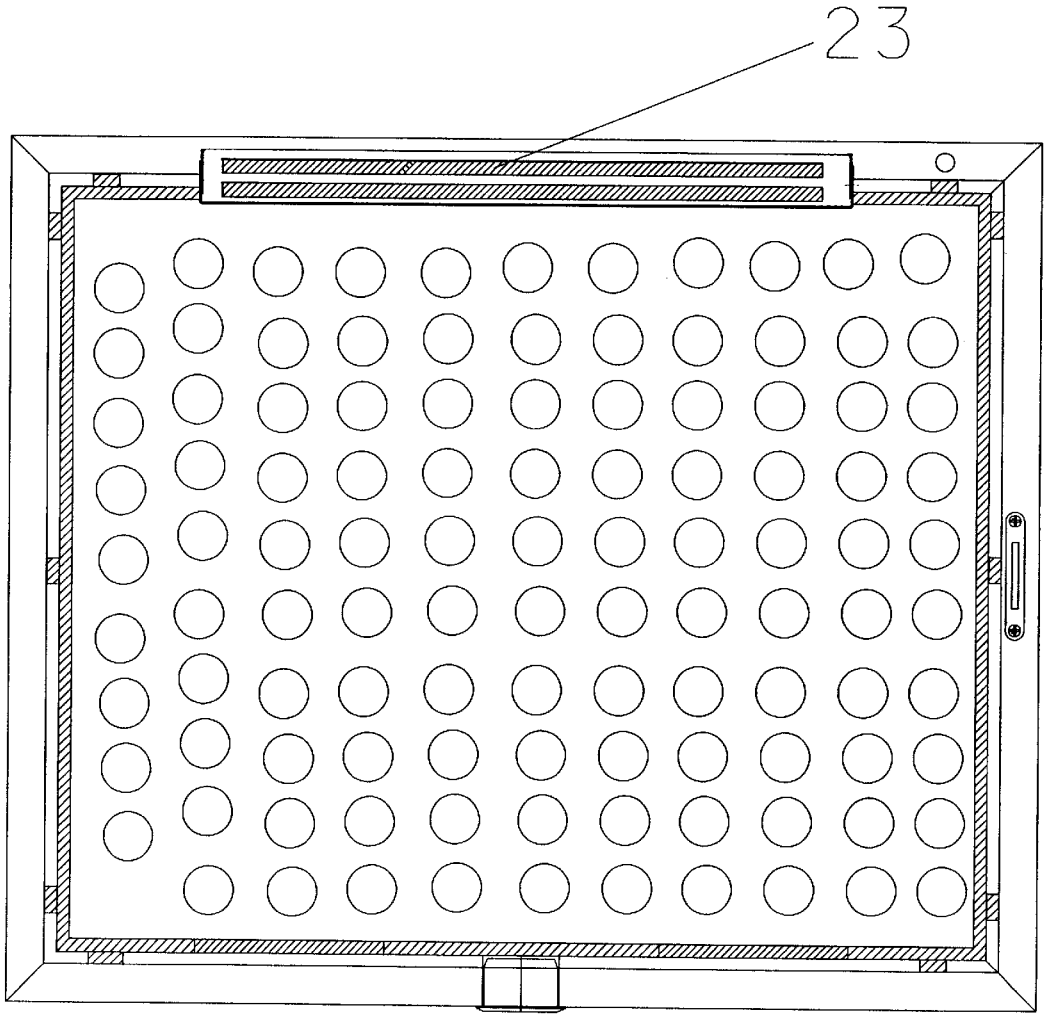
FIG. 8D is a top plan view of the internal venting structure inside the storage compartment

FIG. 8A shows a perspective view of a integrated venting structure 31 Integrated vented structure 31 preferably includes a bottom vent panel 10 spaced above compartment bottom wall 16 via spacers 17. Venting side panels 7 are spaced between side housing walls 11 by spacers 17. Bottom vent panel 10 and venting side panels 7 are constructed of a nontoxic material preferably wood and have air passing vent openings 32 and openings for humidity generating device 33 for humidity generating sources 6 within venting side panels. FIG. 8B shows a top plan view of a storage compartment with integrated venting structure 31. Air passage space 18 provides free movement of air circulation around the entire tobacco contents within the compartment. Hygrometer 9 and humidity generating devices 6 are integrated with air passage space 18 to provide monitoring and accurate humidity within the entire compartment. A locking mechanism 5 is shown located in top of compartment sidewall 11. FIG. 8D shows a top plan of the storage compartment with integrated venting structure. Elongated humidity generating device 23 is made up of a structure usually in the form of a tube partially retained within the compartment housing sidewall.

PREFERRED EMBODIMENT—OPERATION

Operation and use of the fulcrum and cantilever humidor is simple and straight forward. Access to tobacco products in the top compartment is simply achieved by lifting lid 1 open. Access to tobacco products is achieved in the lower compartments by simply rotating upper level compartments around a fulcrum 12 thus exposing the contents in the lower storage compartments. All compartments can be opened at once by simply rotating the top compartment in a continuous 360 degree circle. The rotational stop 28 in FIG 6A will engage the side wall of the lower compartment at approximately 90 degrees. If the circular direction continues by the top compartment it will continue to rotate thus exposing a subsequent lower compartment until all compartments are fully engaged by their stops 28 and are accessible. The bottom compartment and all subsequent higher compartments can also rotate centrally on the bottom base support 24. This is achieved as illustrated in FIG 2B through a simple swivel mechanism integrated into the bottom center of the lowest storage compartment and base 24. This allows 360 degree access to all storage compartments. Without the optional rotational stops 28 the individual compartments can be opened in either direction as illustrated in FIG. 2A allowing customized accessibility by the customer. Individual compartments can be opened without disturbing different compartments by simply rotating any number of compartments in unity. Accessibility and rotational directions of individual compartments can be customized by varying the placement of the fulcrum between the compartments. This is illustrated in FIGS. 3C through 3E.

An airtight seal for each compartment is achieved through a sealing gasket 15 mating with an opposing housing side wall as pictured in FIG. 7*a*. This seal is always tight due to the downward force exerted by the weight of the compartment itself. Individual compartments can be locked through the utilization of a standard locking plate 3 thus preventing access by unauthorized individuals. Monitoring of inside humidity levels of the compartments is achieved by reading the externally displayed hygrometer 9. Humidity generating units 6 & 23 can be removed for charging.

Other Embodiments

Rotational Mechanism—Description

Figure 4A:
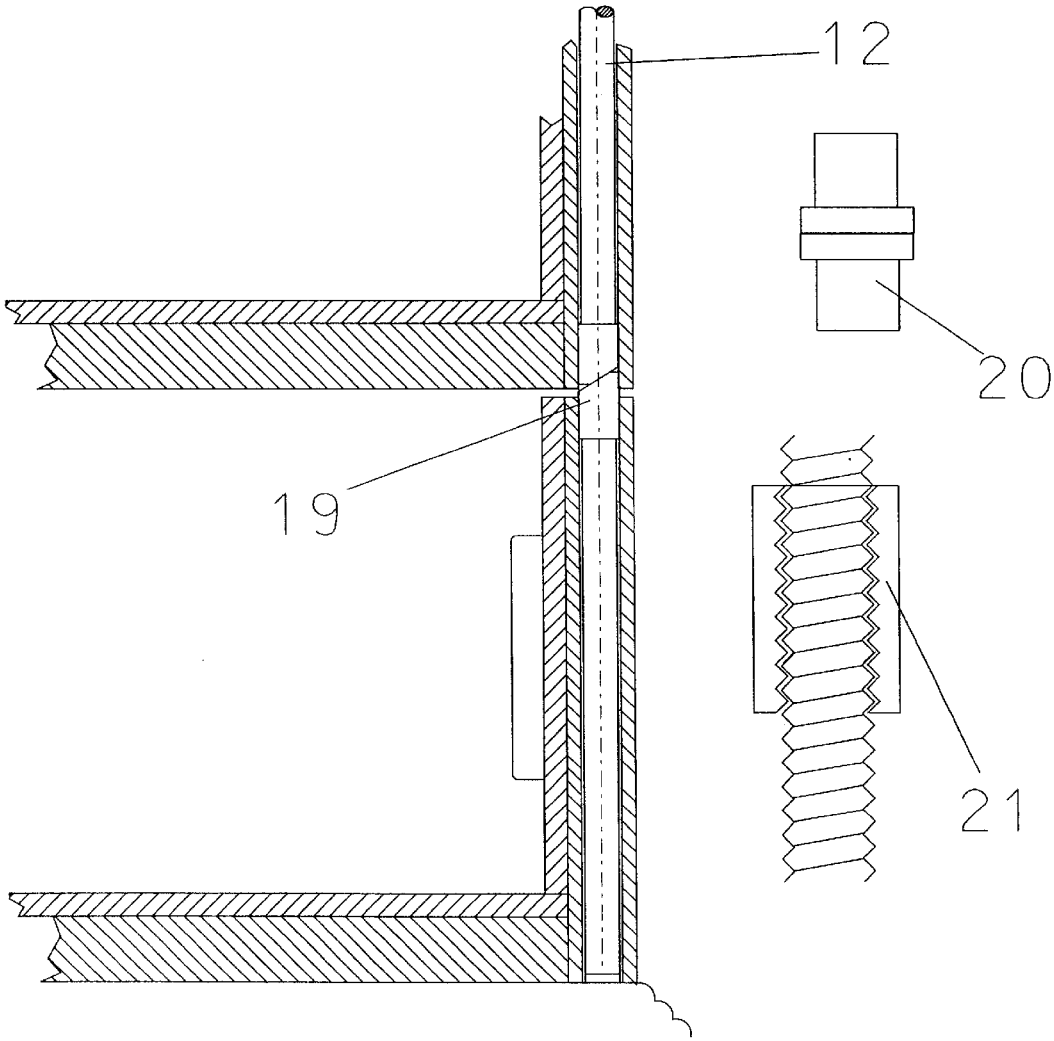

FIG. 4A shows a cross-sectional view of different rotational hinge designs. A rising swivel hinge 19 raises the upper storage compartment when it is rotated around its axis. Rising swivel hinge 19 can incorporate a locking mechanism that will stop rotation at 90 degrees or another suitable opening dimension. In larger volume humidor designs a rising swivel hinge can reduce the wear and potential rolling of the gasket. Threaded hinge 21 shows a different design that can be substituted to produce a constant compression of the gasket material. A simple rotational hinge 20 can also be utilized between the compartments.

Rotational Mechanisms—Operation

Operation is simple with varying designs of rotational hinge mechanisms as illustrated in FIG. 4A. Accessing contents of compartments are basically the same as the preferred embodiment.

Mechanical Seal—Description

Figure 7B:
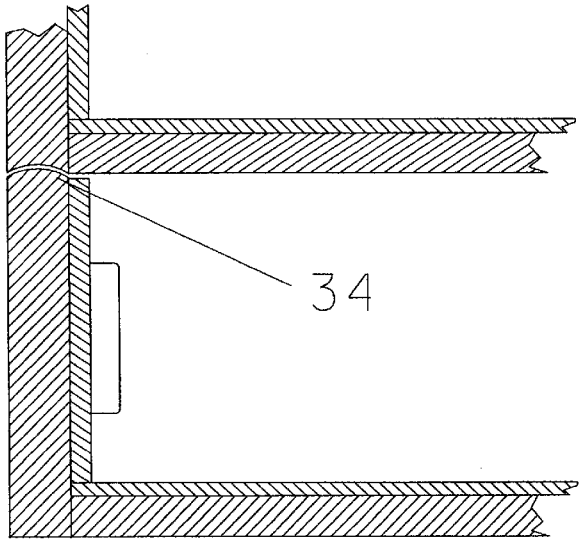
FIG. 7B shows an optional mechanical seal interface between the compartment walls.
Figure 7C:
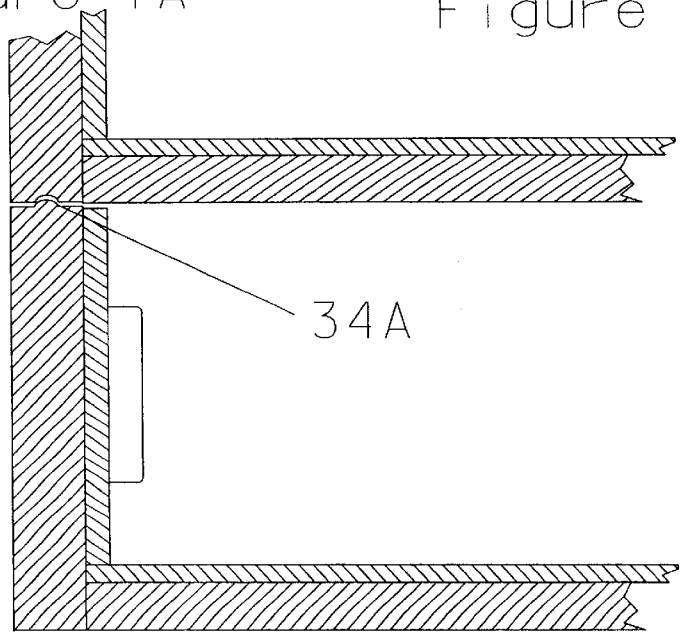
FIG. 7C is a cross-sectional view of an optional mechanical seal between the compartment walls

FIGS. 7B and 7C are a cross-sectional view of different types of mechanical fits that can form a seal between the storage compartments. Mechanical seal 34 and 34A form a tight fit through the utilization of a tongue and groove configuration between the side walls of the upper and lower storage compartments. Mechanical seal 34 and 34A replace the gasket material in the preferred embodiment.

Mechanical Seal—Operation

Operation of the humidor utilizing a mechanical seal as presented in FIG. 7B and 7C is basically the same as the preferred embodiment except that as one rotates the upper compartments a slight lifting action is required to disengage the tongue and groove fit.

Vertical Cantilever—Description

Figure 9A:
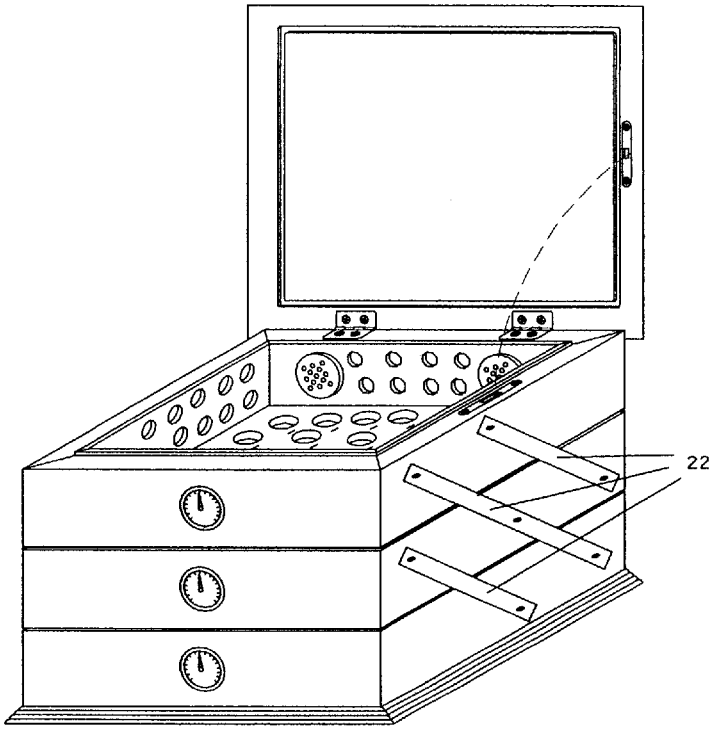
FIG. 9A is a perspective view of my invention with a vertical cantilever opening mechanism
Figure 9B:
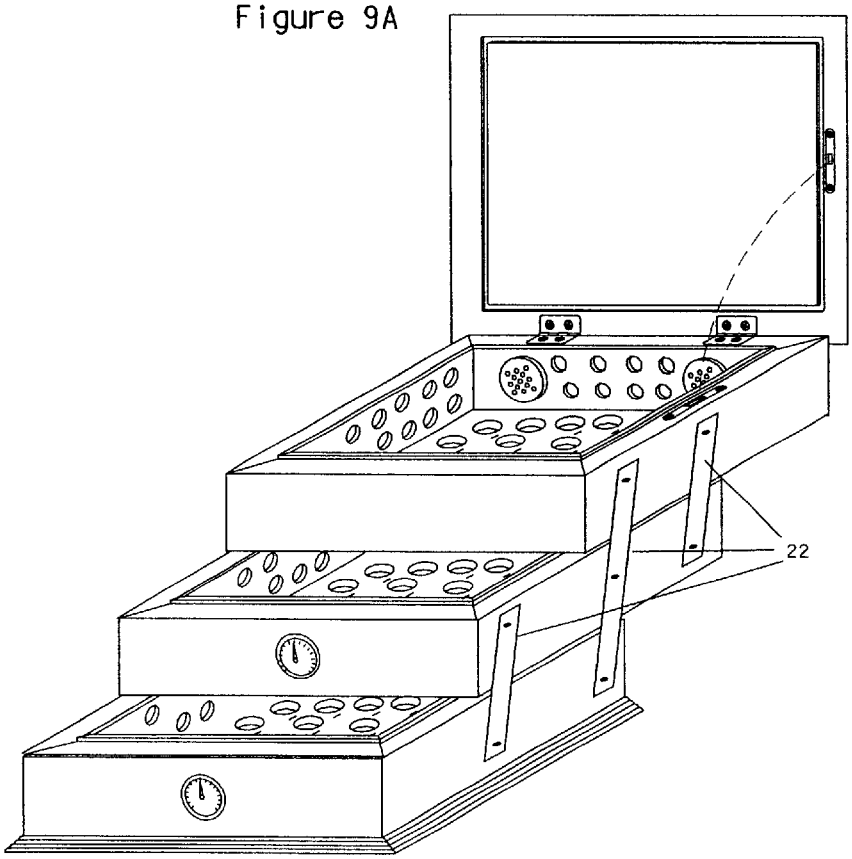
FIG. 9B is a perspective view of my invention with the individual storage compartments opened by a vertical cantilever mechanism

FIGS. 9A and 9B show a perspective view of the humidor with cantilevers 22 mounted on the sides of the storage compartments. The cantilevers are secured by bolts mounted to the individual storage compartments. The cantilever pivots around the bolts secured to the compartments.

Vertical Cantilever—Operation

Operation of the vertical cantilever 22 as pictured in FIGS. 9A and 9B is simply achieved by lifting upward on the top storage compartment. Through cantilever mechanisms 22 the subsequent lower compartments are raised and pivoted backwards thus exposing all compartment contents.

Compartment dividers—Description

Figure 10A:
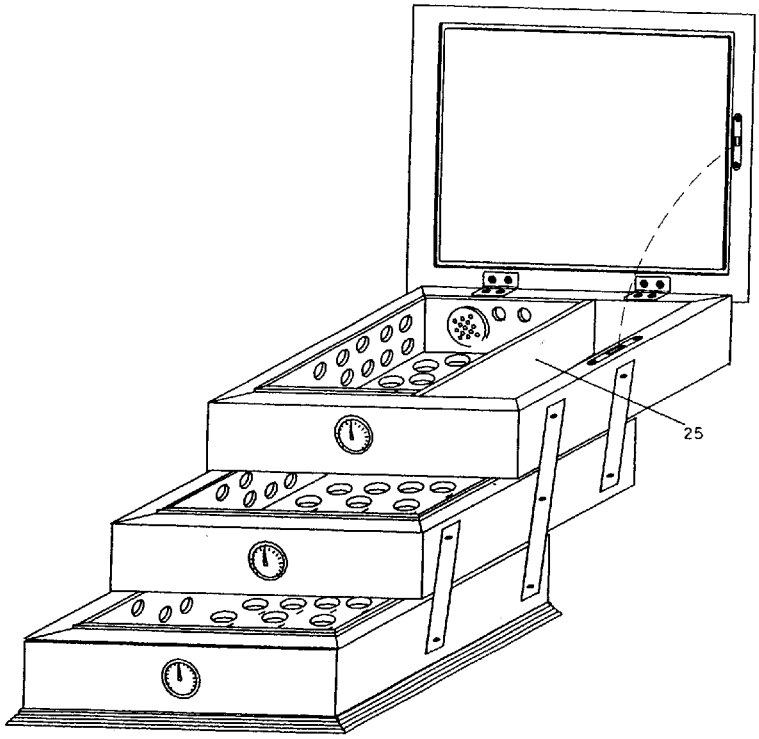
FIG. 10A is a perspective view of my invention showing an optional accessory storage compartment.
Figure 10B:
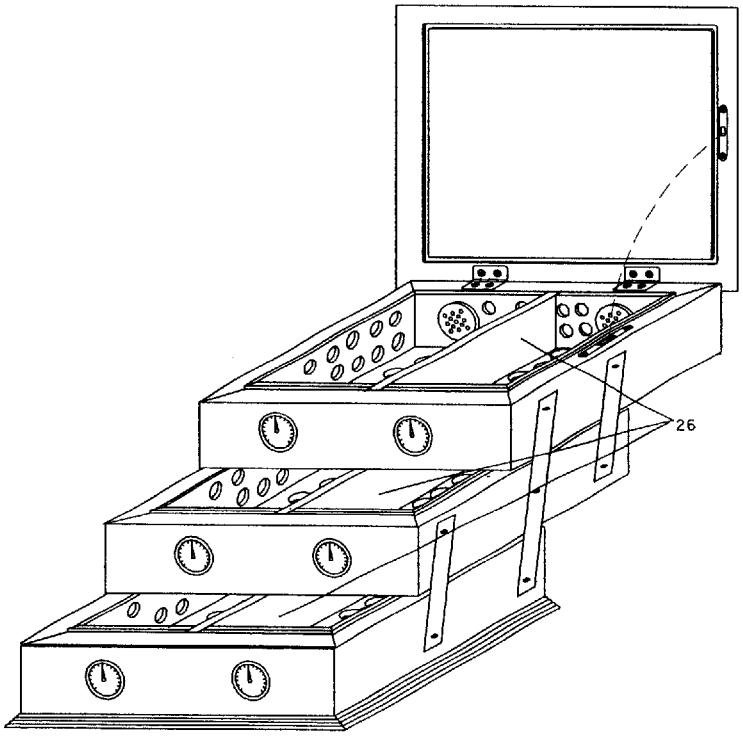
FIG. 10B is a perspective view of my invention with optional dividers within the separate compartments.

FIGS. 10A and 10B show a perspective view of the humidor with a accessory storage divider 25 installed into the compartment. This divider separates the compartment into a humidified section and a non humidified section. This divider is constructed of nontoxic materials. Storage compartment divider 26 can divide the storage compartment into separate and distinct compartments thus increasing the quantity of different tobacco products stored within a given space. Not shown is a compartment divider that is removable and repositionable that fits within the venting structure that allows a customized arrangement of compartment.

Compartment dividers—Operation

Usage of compartment dividers as illustrated in FIGS. 10A and 10B are straight forward. Accessories such as cigar cutters, pipes, lighters, etc. can be stored in one convenient location by sub-dividing the upper compartment with a divider 25. This new section is not in contact with humidity sources. Compartment dividers 26 add increased segmentation to compartments increasing the quantity of unique tobacco products being stored.

Conclusions, Ramifications, and Scope

Accordingly, it can be seen that the invention with independent storage compartments can be arranged in a vertical manner with a fulcrum and cantilever rotational means that allows the compartments to be opened in many swiveable configurations maximizing utilization of space requirements and accessibility while increasing reliability and eliminating external support members. These independent storage compartments prevent the communication and subsequent adulteration of unique tobacco products via migration of airborne ethers. As stated its sealing mechanism provides a more reliable and economical air tight storage compartment that conforms to irregularities and wear while eliminating components, materials and fabrication steps. As stated an integrated venting structure within each independent storage compartment allows free circulation of humidified air around and between tobacco products, humidity generating devices and humidity monitoring devices. As stated monitoring of internal humidity is more accurate and will not compromise the internal environment within each separate storage compartments.

Although the description above contains many specificities, these should not be construed as limiting the scope of the invention but as merely providing illustrations of some of the presently preferred embodiments of this invention. Various other embodiments and ramifications are possible within it's scope. For example, many other ramifications and variations are possible within the teachings of the invention. For example many other rotational means can be employed to allow accessibility to individual storage compartments. In place of a gasket material to seal compartments a mechanical interlocking fit can be utilized to achieve an airtight compartment eliminating additional fabrication and components. By utilizing the cantilever in a vertical arrangement access to all compartments are achieved simultaneously by simply lifting up on the top compartment adding ease and simplicity to operation. Thus the scope of the invention should be determined by the appended claims and their legal equivalents, rather than by the examples given.

What is claimed is:

1. A humidor for storing tobacco products, said humidor comprising:

a plurality of storage compartments, each compartment comprising:

a bottom wall defining a first and second side;

a side wall formed adjacent to said first side of said bottom wall;

sealing means attached to said second side of said bottom wall for creating a seal;

a humidity generating means;

a humidity monitoring means; and attachment means for movably attaching each of said compartments to adjacent compartments; and each of said compartments are stacked vertically.

2. The humidor of claim 1 wherein:

the number of said compartments is user determined by adding or removing the compartments.

3. The humidor of claim 1 wherein:

said attachment means comprises a rotational attachment means.

4. The humidor of claim 1 and further comprising:

a hole formed in said side wall;

a fulcrum; and wherein said hole pivotally slides against said fulcrum.

5. The humidor of claim 4 and further comprising:

a rotational stop formed on said side wall.

6. The humidor of claim 4 wherein:

the attachment means comprises a rising swivel hinge, said hinge comprising a first member and a second member;

wherein said first and second members pivotally slide on said fulcrum; and wherein said first and second members slide relative to each other.

7. The humidor of claim 4 wherein:

said attachment means comprises a threaded hinge for moving said compartments along a vertical axis.

8. The humidor of claim 1 wherein said humidity monitoring means is attached to said side wall.

9. The humidor of claim 1 wherein said humidity generating means is attached to said side wall.

10. The humidor of claim 1 and further comprising:

a lock mechanism; and wherein said lock mechanism interacts with a first compartment and a second compartment; and an integrated venting structure adjacent to said bottom wall, said integrated venting structure comprising a plurality of venting passages spaced above said bottom wall and said side wall.

11. The humidor of claim 10 and further comprising:

a divider disposed within said integrated venting structure.

12. The humidor of claim 1 and further comprising:

a cantilever;

a first hole formed in said side wall of a first compartment;

a second hole formed in said side wall of a second compartment;

wherein said cantilever is pivotally attached to said first compartment by said first hole; and wherein said cantilever is pivotally attached to said second compartment by said second hole.

13. A humidor comprising: a plurality of vertically arranged storage compartments which comprise at least one side wall and a bottom wall, with said compartments sealably preventing direct communication between any of said compartments, wherein said compartments utilize rotational means for allowing separate access to each of said compartments, wherein said compartments retain an integrated venting structure allowing free air circulation between a humidity generating means, a humidity monitoring means and a plurality of tobacco products, wherein the venting structure comprises a venting panel with a plurality of venting passages spaced above said compartment side and bottom walls.

* * * * *